US011124005B2

(12) United States Patent
Baba

(10) Patent No.: US 11,124,005 B2
(45) Date of Patent: Sep. 21, 2021

(54) IMAGE RECORDING APPARATUS, INFORMATION PROCESSING METHOD, AND STORAGE MEDIUM

(71) Applicant: CANON KABUSHIKI KAISHA, Tokyo (JP)

(72) Inventor: Naoko Baba, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/775,122

(22) Filed: Jan. 28, 2020

(65) Prior Publication Data

US 2020/0247163 A1 Aug. 6, 2020

(30) Foreign Application Priority Data

Feb. 5, 2019 (JP) ..... JP2019-019200

(51) Int. Cl.
*B41J 29/393* (2006.01)

(52) U.S. Cl.
CPC ..... *B41J 29/393* (2013.01)

(58) Field of Classification Search
CPC ..... B41J 29/393; B41J 2/2054; B41J 2/2114; B41J 2/17546; B41J 2/17566; B41J 29/38
USPC ..... 347/19
See application file for complete search history.

(56) References Cited

U.S. PATENT DOCUMENTS

2013/0100191 A1* 4/2013 Miyamoto ..... B41J 2/2114 347/14
2016/0347081 A1* 12/2016 Fukasawa ..... B41J 2/2142

FOREIGN PATENT DOCUMENTS

JP 2017-217891 A 12/2017

* cited by examiner

*Primary Examiner* — Huan H Tran
*Assistant Examiner* — Alexander D Shenderov
(74) *Attorney, Agent, or Firm* — Canon U.S.A., Inc. IP Division

(57) ABSTRACT

With a conventional method of estimating an application amount of a clear recording material from a color of a patch, it is difficult to realize high accuracy, similar colors are sometimes exhibited in measurement results even if there is a significant difference in the application amount of a clear ink. In contrast, with a disclosed configuration of estimating an application amount of a clear recording material from a reflection intensity of a patch, measurement results that exhibit a one-dimensional increase of a relationship between the application amount of the clear recording material and the reflection intensity are acquired, so that the accuracy of application amount estimation increases.

18 Claims, 15 Drawing Sheets

IMAGE RECORDING APPARATUS, INFORMATION PROCESSING METHOD, AND STORAGE MEDIUM

BACKGROUND

Field

The present disclosure relates to an image recording apparatus configured to record an image on a recording medium, an information processing method, and a storage medium.

Description of the Related Art

Inkjet recording apparatuses that include a recording head with a plurality of ejection openings have been widely used. Using the inkjet recording apparatus, a desired color tone may not be appeared in an image due to a difference in ejection characteristics among recording heads of the inkjet recording apparatus. In relation to the difference in ejection characteristics among the recording heads, color shift correction processing is performed to a color difference that occurs in an image.

Meanwhile, a clear ink that contains no colorant is used to increase image quality of a recorded image and add glossiness to the recorded image. The above-described difference in ejection characteristics occurs also in the case where the clear ink is used. In other words, the difference in ejection characteristics of the clear ink also needs to be corrected as in the case of an ink that contains a colorant. In the correction process, an issue arises that the measurement accuracy of a patch pattern for acquiring an ejection characteristic of a clear ink is low.

Japanese Patent Application Laid-Open No. 2017-217891 discusses a technique in which patches that include a black ink layer formed using a black ink under a clear ink layer are recorded in calibration of a clear ink that contains no colorant. The method discussed in Japanese Patent Application Laid-Open No. 2017-217891 estimates an amount of ejection by calculating an interference color from a measurement result of the patches for calibration of the clear ink. Specifically, light-emitting diodes (LEDs) R, G, and B of light emitting portions of an optical sensor are sequentially turned on, and specular reflection light is read, and an amount of ejection of the clear ink is estimated from an intensity ratio of the three colors.

SUMMARY

According to an aspect of the present disclosure, an image recording apparatus configured to record an image on a recording medium includes a recording unit configured to record a test pattern for a clear recording material by forming a second layer of the clear recording material containing no colorant on a first layer formed on the recording medium, the first layer being a layer of a color recording material containing a colorant, an acquisition unit configured to acquire a reflection intensity of specular reflection light of the test pattern for the clear recording material, and a generation unit configured to generate information for determining an application amount of the clear recording material in image recording, based on the reflection intensity acquired by the acquisition unit and a target value indicating the reflection intensity of the specular reflection light with respect to the application amount of the clear recording material.

Further features of the present disclosure will become apparent from the following description of exemplary embodiments with reference to the attached drawings.

DESCRIPTION OF THE EMBODIMENTS

Various exemplary embodiments of the present disclosure will be described below with reference to the drawings.

Figure 1:
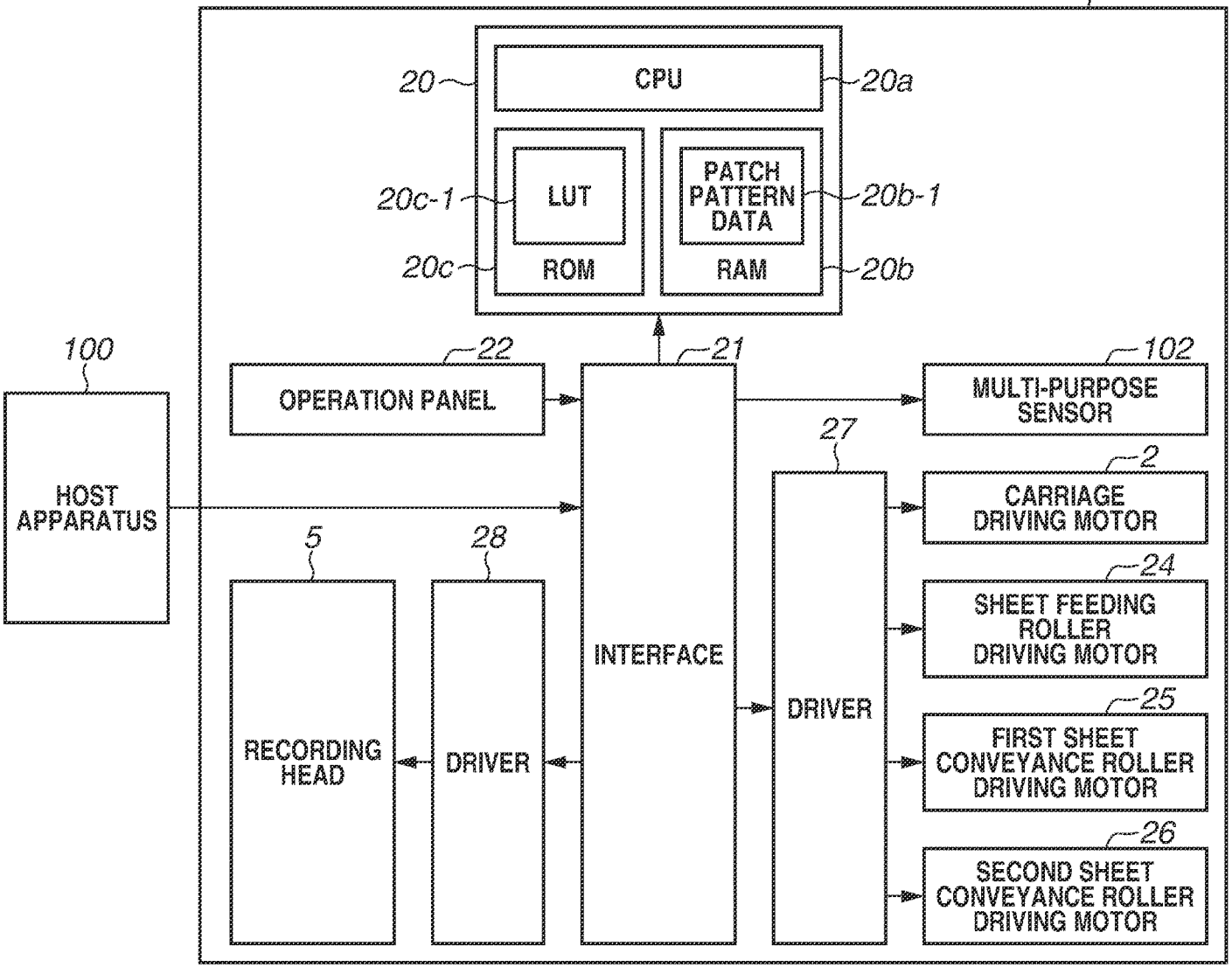
FIG. 1 is a block diagram illustrating a control configuration of a recording system.

FIG. 1 is a block diagram illustrating a control configuration of a recording system according to a first exemplary embodiment. The recording system according to the present exemplary embodiment includes a host apparatus 100 and a recording apparatus 200. The host apparatus 100 is an information processing apparatus, such as a personal computer or a digital camera. The recording apparatus 200 is connected to the host apparatus 100 via an interface 21 and receives recording data R', G', B' for image processing described below and a table for post-image processing from the host apparatus 100. Then, the recording apparatus 200 executes especially image processing such as color processing and binarization processing and recording characteristic correction processing described below based on transmitted image processing information, and records an image on a recording medium based on recording data having undergone various types of image processing.

In the recording apparatus 200, a control unit 20 includes a central processing unit (CPU) 20*a*, such as a microprocessor, a read-only memory (ROM) 20*c*, and a random access memory (RAM) 20*b* as a memory. The ROM 20*c* stores a control program of the CPU 20*a* and various types of data such as parameters that are necessary for recording operations. The RAM 20*b* is used as a work area of the CPU

20*a* and temporarily stores various types of data, such as image data received from the host apparatus 100 and generated recording data. Further, the ROM 20*c* stores a lookup table (LUT) as correction information, and the RAM 20*b* stores patch pattern data for patch pattern recording. Alternatively, the LUT can be stored in the RAM 20*b*, and the patch pattern data can be stored in the ROM 20*c*. Further, a color shift correction LUT described below and a control program for generating the color shift correction LUT are stored in the ROM 20*c*.

The control unit 20 performs input-output processing to input data and parameters for use in recording, such as image data, and receive output data and parameters for use in recording to and from the host apparatus 100 via the interface 21. The control unit 20 also inputs various types of information, such as a character pitch and character type, via an operation panel 22. Further, the control unit 20 outputs ON/OFF signals for driving motors 23 to 26 via the interface 21. Further, the control unit 20 outputs an ejection signal to a driver 28 and controls driving of a recording element for ejecting an ink from a recording head.

Further, this control system includes the interface 21, the operation panel 22, a multi-purpose sensor 102, and drivers 27 and 28. The driver 27 drives the carriage driving motor 23 for driving a carriage 6, the sheet feeding roller driving motor 24 for driving a sheet feeding roller (not illustrated), the sheet conveyance roller driving motor 25 for driving a sheet conveyance roller 3, and the sheet conveyance roller driving motor 26 for driving a sheet conveyance roller 4 based on an instruction from the CPU 20*a*. Similarly, the driver 28 drives a recording head 5.

Figure 2:
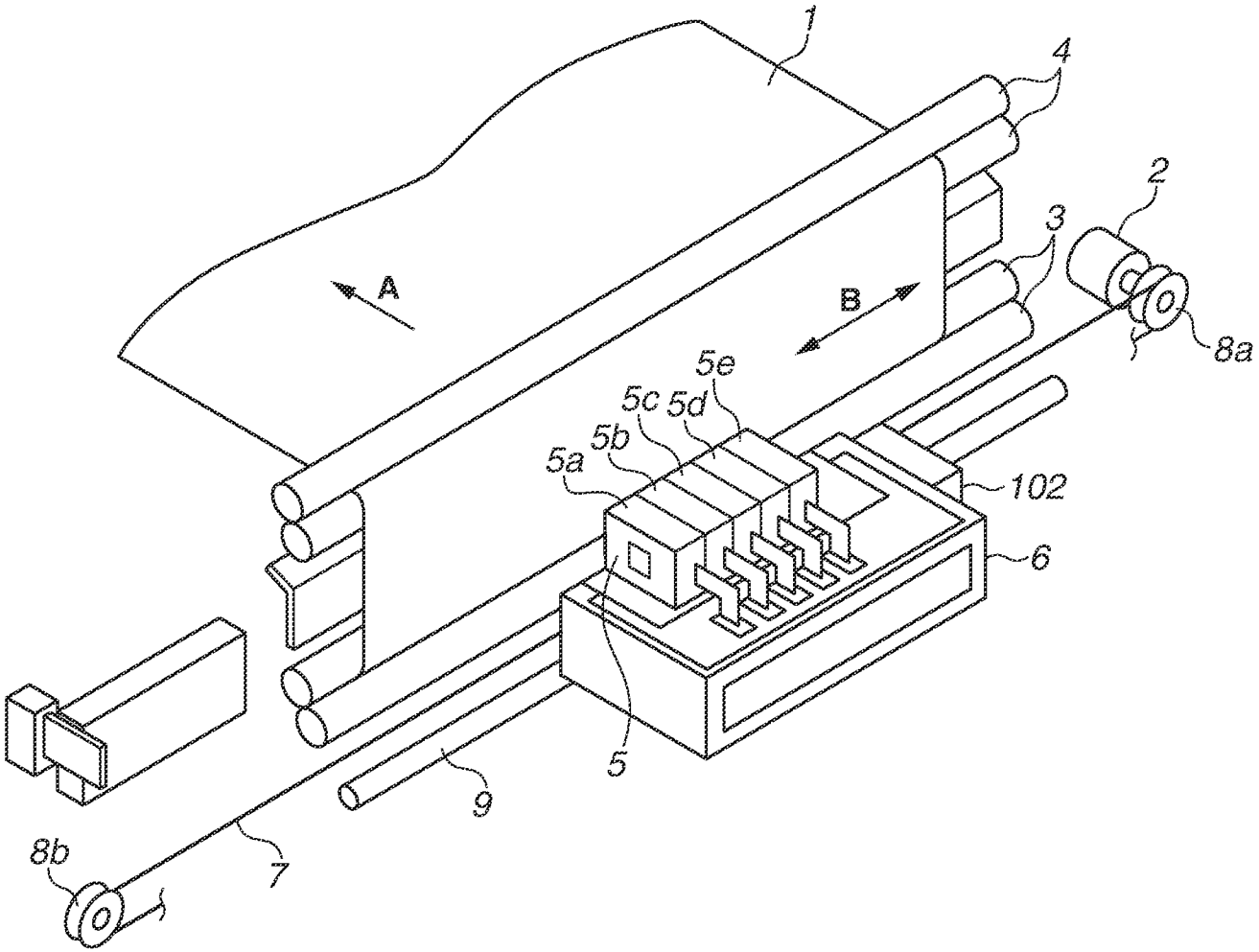
FIG. 2 is a schematic perspective view illustrating a mechanical configuration of a recording apparatus.

FIG. 2 is a schematic perspective view illustrating a mechanical structure of the recording apparatus 200. A plurality of recording mediums 1, such as recording sheets and plastic sheets, is stacked on a cassette (not illustrated), and the sheet feeding roller (not illustrated) separates the recording mediums 1 one by one and feeds the separated recording medium 1 at the time of recording. The fed recording medium 1 is conveyed by a predetermined amount each time in the direction of an arrow A (hereinafter, also referred to as "sheet conveyance direction") by the sheet conveyance rollers 3 and 4, which are provided with a predetermined interval therebetween, at a timing corresponding to a scan of the recording head 5. The sheet conveyance roller 3 includes a pair of a driving roller and a driven roller. The driving roller is driven by a stepping motor (not illustrated), and the driven roller is rotated as the driving roller rotates. Similarly, the sheet conveyance roller 4 includes a pair of rollers. The recording apparatus 200 can record an image on not only a recording medium that is cut into a predetermined size and stacked on the cassette but also a recording medium that is provided in the shape of a roll and is long in the sheet conveyance direction.

The recording head 5 is mounted on the carriage 6. Driving force from the carriage driving motor 2 is transmitted to the carriage 6 via a belt 7 and pulleys 8*a* and 8*b*. The driving force causes the carriage 6 to scan forward and backward along a guide shaft 9 in the direction of an arrow B (hereinafter, referred to as "scan direction") in FIG. 2. During the forward and backward scan, the recording head 5 ejects ink droplets, and an image is recorded on the recording medium 1. Further, the multi-purpose sensor 102 described below is mounted on a side surface of the carriage 6. The multi-purpose sensor 102 is used to detect a density of ink ejected to the recording medium 1, a gloss value, a width of the recording medium 1, and a distance from the recording head 5 to the recording medium 1.

The recording head 5 is moved to a home position as needed, and an ejection recovery apparatus provided at the home position performs a recovery operation to recover the recording head 5 from a state where ejection from ejection openings fails due to a clogged opening. After the recording and scanning by the recording head 5, the sheet conveyance rollers 3 and 4 are driven, and the recording medium 1 is conveyed in the sheet conveyance direction by a predetermined amount. The recording and scanning by the recording head 5 and the operation of conveying the recording medium 1 are alternately repeated to record an image on the recording medium 1.

Figure 3:
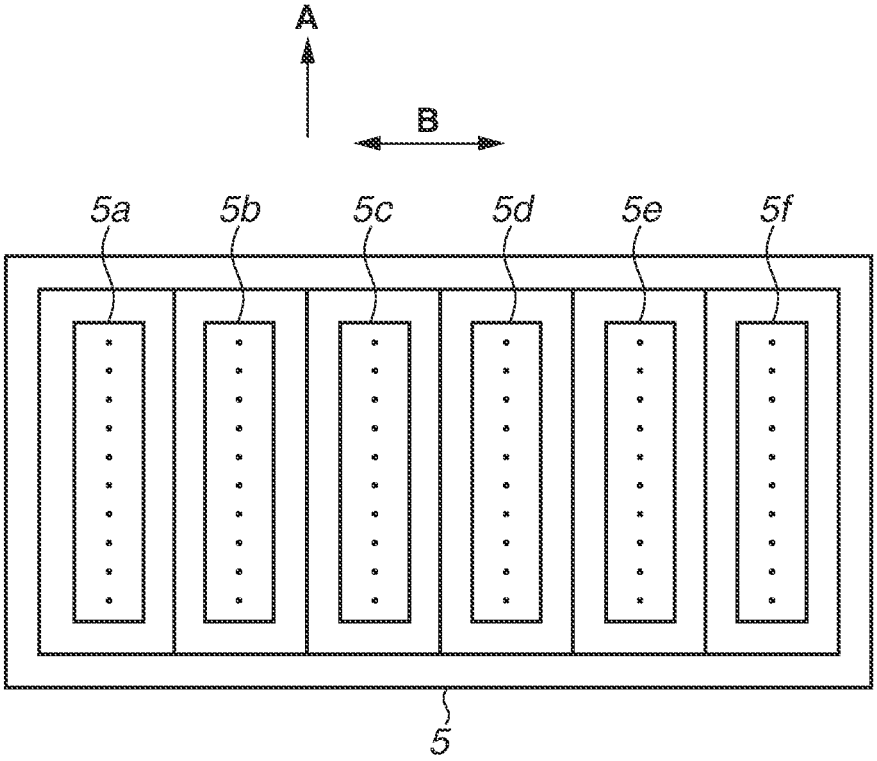
FIG. 3 is a front view illustrating a recording head.

FIG. 3 is a front view illustrating the recording head 5 viewed from a surface that includes the ejection openings. The recording head 5 according to the present exemplary embodiment is an inkjet recording head that ejects ink from the ejection openings (nozzles) using energy from a recording element. The ejection openings that eject the same ink are arranged in a row along an array direction, and a plurality of ejection opening rows is arrayed to overlap when viewed from the scan direction in which the recording head 5 scans. In the present exemplary embodiment, an electrothermal conversion element (heater) is provided as a recording element in each ejection opening from which ink is ejected. The electrothermal conversion element is driven by an ejection signal based on image data, and bubbles are formed in the ink using the generated heat energy, and the ink in the ejection opening is ejected by the pressure of the bubbles. The ejected ink droplets land on the recording medium 1 and form dots on the recording medium 1.

In the present exemplary embodiment, inks are used as recording materials, color inks are used as color recording materials containing a colorant, and a clear ink is used as a clear recording material containing no colorant. The recording head 5 according to the present exemplary embodiment ejects four color inks that are a cyan ink (C) containing a cyan colorant, a magenta ink (M) containing a magenta colorant, a yellow ink (Y) containing a yellow colorant, and a black ink (K) containing a black colorant. The recording head 5 further ejects a clear ink (S) containing no colorant. The inks are supplied from ink cartridges (not illustrated) and ejected from ejection opening rows 5*a* to 5*e*. In FIG. 3, the cyan ink (C), the magenta ink (M), the yellow ink (Y), the black ink (K), and the clear ink (S) are supplied to the ejection opening rows 5*a*, 5*b*, 5*c*, 5*d*, and 5*e*, respectively. While FIG. 3 illustrates an example in which ten ejection openings are formed in each ejection opening row for simplification, the number of ejection openings and the number of ejection opening rows are not limited to those described above. Furthermore, the colors of the color inks are not limited to those described above in the example.

<Ink Formulation>

Ink formulation will be described in detail below. Unless otherwise specified, the terms "parts" and "%" refer to "parts by mass" and "% by mass".

<Preparation of Pigment Dispersion Liquid>

(Preparation of Black Pigment Dispersion Liquid)

First, 20.0 parts of a pigment, 60.0 parts of an aqueous resin solution, and 20.0 parts of water were put into a bead mill (LMZ2; manufactured by Ashizawa Finetech) with a fill rate of 80% of zirconia beads in 0.3 mm diameter and dispersed at 1,800 revolutions per minute (rpm) for five hours. A carbon black (product name: Printex® 90; manufactured by Degussa) was used as the pigment. An aqueous solution of 20.0% resin content (solid content) containing Joncryl® 678 (manufactured by Johnson Polymer), which is a styrene-acrylic acid copolymer, neutralized with potassium hydroxide of an equivalent weight to an acid value was used as the aqueous resin solution. Thereafter, the mixture was centrifuged at 5,000 rpm for 30 minutes to remove aggregated components, and the resulting mixture was diluted with an ion-exchange water to obtain a black pigment dispersion liquid with 15.0% pigment content and 9.0% water-soluble resin (dispersion agent) content.

(Preparation of Magenta Pigment Dispersion Liquid)

The pigment was changed to a C. I. pigment red 122 (product name: toner magenta E02; manufactured by Clariant). A similar procedure to the above-described procedure of preparing the black pigment dispersion liquid, except for the pigment, was conducted to obtain a magenta pigment dispersion liquid with 15.0% pigment content and 9.0% water-soluble resin (dispersion agent) content.

(Preparation of Cyan Pigment Dispersion Liquid)

The pigment was changed to a C. I. pigment blue 15:3 (product name: toner cyan BG; manufactured by Clariant). A similar procedure to the above-described procedure of preparing the black pigment dispersion liquid, except for the pigment, was conducted to obtain a cyan pigment dispersion liquid with 15.0% pigment content and 9.0% water-soluble resin (dispersion agent) content.

(Preparation of Yellow Pigment Dispersion Liquid)

The pigment was changed to a C. I. pigment yellow 74 (product name: Hansa Brilliant Yellow 5GX; manufactured by Clariant). A similar procedure to the above-described procedure of preparing the black pigment dispersion liquid, except for the pigment, was conducted to obtain a yellow pigment dispersion liquid with 15.0% pigment content and 9.0% water-soluble resin (dispersion agent) content.

<Ink Preparation>

After the components (unit: %) specified in an upper section of Table 1 were mixed together, the mixture was filtered under pressure with a membrane filter (HDC® II filter; manufactured by Pall) having a pore size of 1.2 μm to prepare pigment inks 1 to 6. The ion-exchange water was used in an amount that was determined so that the total content of the components was 100.0%. Acetylenol® E100 is a surfactant manufactured by Kawaken Fine Chemicals. In a lower section of Table 1, the pigment contents (unit: %) in the pigment inks are specified. The obtained inks were put into respective cartridges.

TABLE 1

Ink Composition and Characteristic

| Ink Name | K | C | M | Y |
|---|---|---|---|---|
| Black Pigment Dispersion Liquid | 30 | | | |
| Cyan Pigment Dispersion Liquid | | 30 | | |
| Magenta Pigment Dispersion Liquid | | | 30 | |
| Yellow Pigment Dispersion Liquid | | | | 30 |
| Glycerin | 10 | 10 | 10 | 10 |
| Ethylene Glycol | 10 | 10 | 10 | 10 |
| Acetylenol ® E100 | 1 | 1 | 1 | 1 |
| Ion-Exchange Water | 49 | 49 | 49 | 49 |
| Pigment Density | 4.5 | 4.5 | 4.5 | 4.5 |

<Preparation of Clear Ink S>

Preparation of Aqueous Resin Solution

An aqueous solution of 20.0% resin content (solid content) containing Joncryl® 678 (manufactured by Johnson Polymer), which is a styrene-acrylic acid copolymer, neutralized with potassium hydroxide of an equivalent weight to an acid value was used as the aqueous resin solution.

Ink Preparation

After the components (unit: %) specified in Table 2 were mixed together, the mixture was filtered under pressure with a membrane filter (HDC® II filter; manufactured by Pall) having a pore size of 1.2 μm to prepare a resin-containing clear ink S. The ion-exchange water was used in an amount that was determined so that the total content of the components was 100.0%. Acetylenol® E100 is a surfactant manufactured by Kawaken Fine Chemicals. The obtained clear ink S was put into a cartridge.

TABLE 2

Ink Composition

| Ink Name | S |
|---|---|
| Aqueous Resin Solution | 20 |
| Glycerin | 10 |
| Ethylene Glycol | 10 |
| Acetylenol ® E100 | 1 |
| Ion-Exchange Water | 59 |

The clear ink (S) according to the present exemplary embodiment is an ink that is to be applied onto a color ink layer formed by a color ink. The clear ink is applied onto the color ink so that the gloss value of the surface of the recorded image is increased, compared to a case where there is only a color ink layer.

(Multi-Purpose Sensor)

Figure 4:
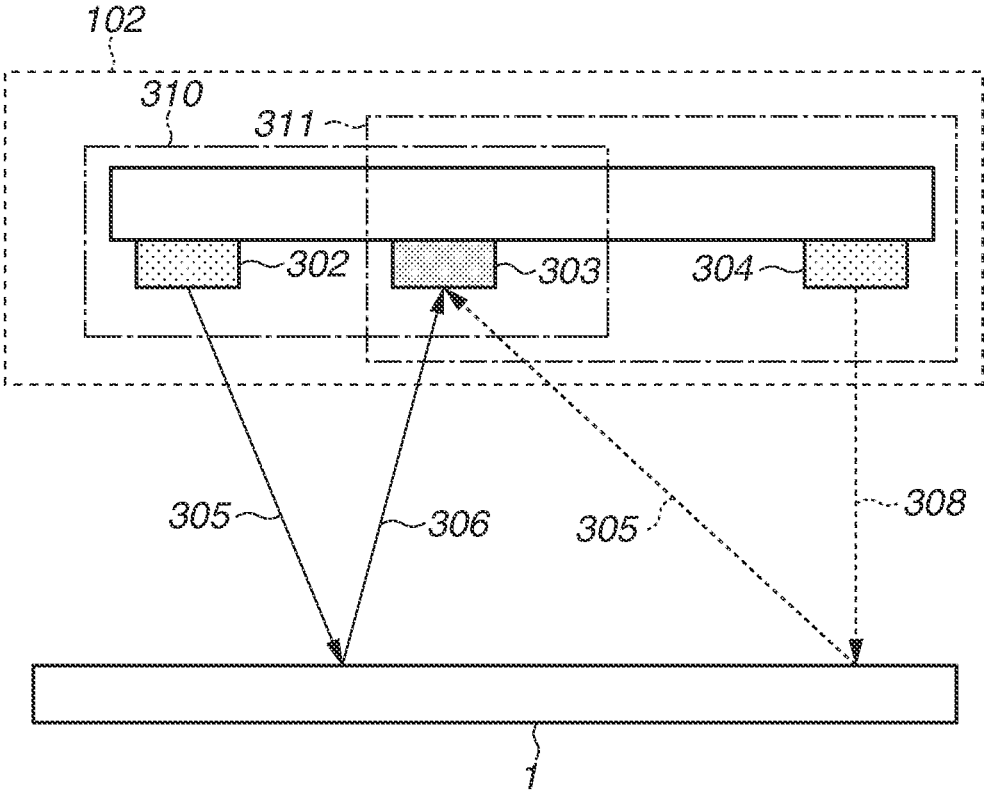
FIG. 4 is a diagram illustrating a configuration of a multi-purpose sensor.

FIG. 4 illustrates a structure of the multi-purpose sensor 102 attached to the recording apparatus 200. In the present exemplary embodiment, the multi-purpose sensor 102 is mounted on the carriage 6, and as the carriage 6 scans, the multi-purpose sensor 102 moves and acquires the density and the gloss value of an image on the recording medium 1 while moving. A lower surface of the multi-purpose sensor 102 is situated at the same position as the ejection opening surface of the recording head 5 or at a greater distance from the recording medium 1 than the distance of the ejection opening surface of the recording head 5 from the recording medium 1.

The multi-purpose sensor 102 includes two light emitting portions 302 and 304 and a light receiving portion 303. The light emitting portions 302 and 304 are configured with three visible light-emitting diodes (LEDs) R, G, and B, and the light receiving portion 303 is configured with a photo diode. Illumination light from the light emitting portion 302 enters the recording medium 1 at an angle of 45 degrees, and the light that is reflected at the same angle, i.e., specular reflection light, is received by the light receiving portion 303. The light emitting portion 302 and the light receiving portion 303 in combination function as a specular reflection sensor, which will be referred to as a specular reflection sensor 310. As described below, the specular reflection light varies in the amount of reflection light due to an effect of an uneven surface of the recording medium 1 and an index of refraction. Thus, the specular reflection sensor 310 is used to detect the gloss value of the recording medium 1. Further, illumination light from the light emitting portion 304 enters the recording medium 1 at an angle of zero degrees, and the light that is reflected is received by the light receiving portion 303. Specifically, the light emitting portion 304 and the light receiving portion 303 in combination function as a diffuse reflection sensor, which will be referred to as a diffuse reflection sensor 311. The diffuse reflection sensor 311 detects diffuse reflection light that does not contain specular reflection light. Thus, the diffuse reflection sensor 311 is used as a density sensor that detects the color density of a surface of the recording medium 1.

In a calibration process described below, the conveyance of the recording medium 1 in the sheet conveyance direction and the scan of the carriage 6 with the multi-purpose sensor 102 in the scan direction are alternately performed. The diffuse reflection sensor 311 of the multi-purpose sensor 102 detects a density of each patch recorded on the recording medium 1 as an optical reflection rate and measures a patch pattern recording density. A patch formed on the recording medium 1 is illuminated with light, and a reflection intensity level that reflects the density of the patch is detected. In a case where the color of the surface of the recording medium 1 is white, the reflection intensity is high, and the higher the density of the patch is, the lower the reflection intensity becomes. On the other hand, the specular reflection sensor 310 of the multi-purpose sensor 102 detects the gloss value of each patch recorded on the recording medium 1 as an optical reflection rate and measures the gloss value. In the present exemplary embodiment, a straight line that connects a central point of an illumination range of illumination light emitted from the light emitting portion 304 to a measurement surface and a center of the light emitting portion 304 will be referred to as an optical axis of a light emitting element. The optical axis of the light emitting element is also a center of a light flux of the illumination light. A line that connects a central point of a region (range) of the measurement target surface where the light receiving portion 303 can receive light and a center of the light receiving portion 303 will be referred to as an optical axis of a light reception element (light reception axis). The light reception axis is also a center of a light flux of reflection light that is reflected at the measurement surface and received by the light receiving portion 303. Alternatively, instead of sharing the light receiving portion 303 as the light receiving portion of the specular reflection sensor 310 and the light receiving portion of the diffuse reflection sensor 311, a light receiving portion can be provided to each sensor. Further, the number of colors of the LEDs of the light emitting portions 302 and 304 are not limited to that described above.

(Image Processing Method)

Next, an image processing method for generating recording data for recording an image in the recording apparatus 200 will be described below.

Figure 5:
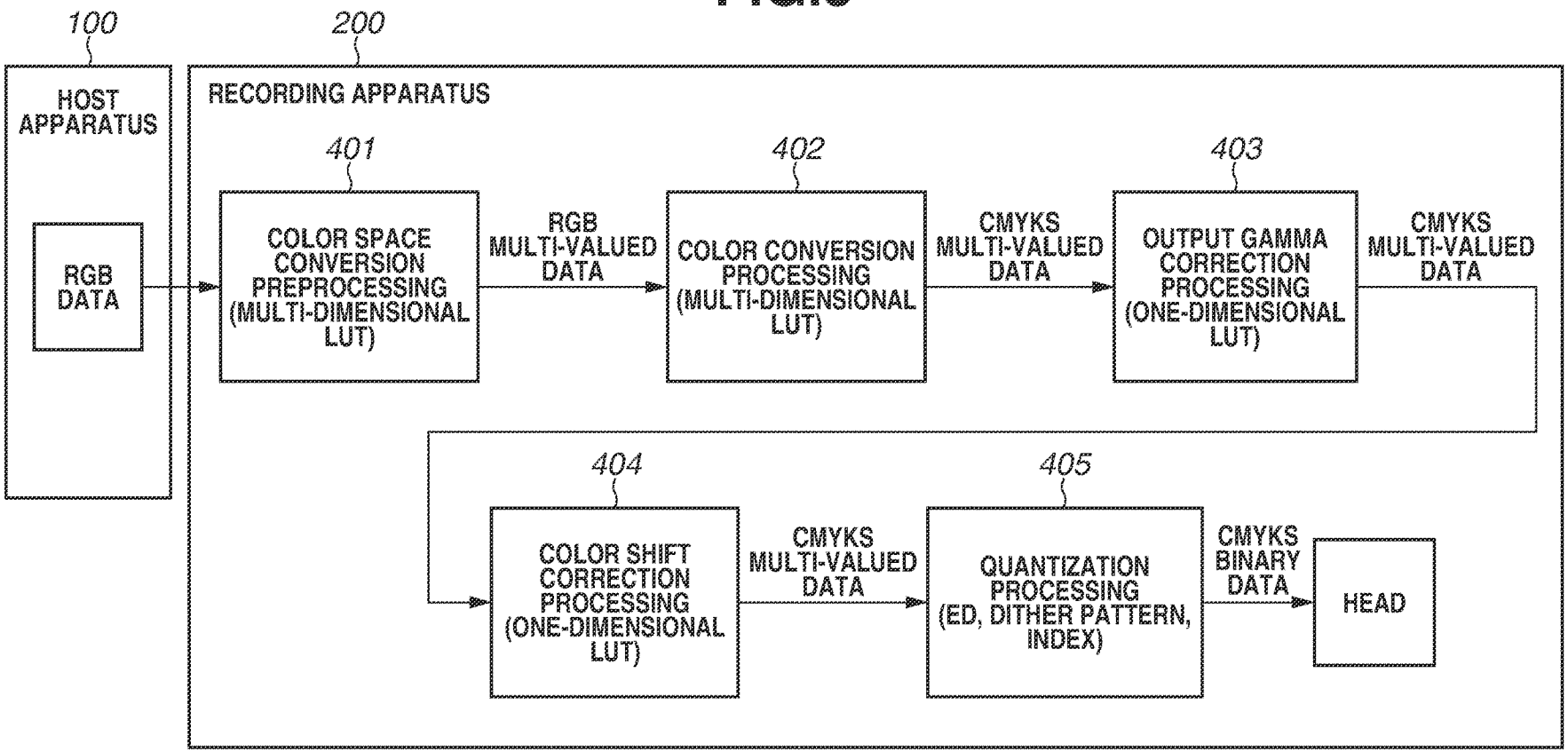
FIG. 5 is a block diagram illustrating a process of image processing by the recording system.

FIG. 5 illustrates a process of image processing according to the present exemplary embodiment. In the process, 1-bit bit image data that indicates whether an ink droplet is to be ejected or not ejected from the ejection openings of the recording head 5 is generated from 8-bit luminance data on red (R), green (G), and blue (B). The color type and color gradation as data elements are not limited to the above-described values.

First, image data represented by 8-bit luminance signals R, G, B is transmitted from the host apparatus 100 to the recording apparatus 200. In this process, the image data is multi-valued data with 256 gradations for each color. Then, in step S401, color space conversion preprocessing (hereinafter, also referred to as "color preprocessing") is performed. The image data represented by the multi-valued luminance signals R, G, B is converted into R', G', B' multi-valued data using a multi-dimensional LUT 401. The color preprocessing is performed to correct the difference between a color space of an input image represented by the R, G, B image data in the recording target and a color space that is reproducible by the recording apparatus 200.

Next, in step S402, color conversion processing (hereinafter, also referred to as "color postprocessing") is performed. The recording apparatus 200 receives the R', G', B' data that has undergone the color preprocessing from the host apparatus 100. The received R', G', B' data is converted into C, M, Y, K, S multi-valued data, which are ink colors, using a multi-dimensional LUT 402. The color postprocessing is the processing of converting RGB value image data at input end that is represented by luminance signals into CMYKS value image data at output end that is represented by density signals.

In step S403, output gamma correction processing is performed for each color on the C, M, Y, K, S multi-valued data having undergone the color postprocessing using a one-dimensional LUT. In general, the relationship between the number of ink droplets (dots) applied per unit area of the recording medium 1 and a recording characteristic obtained by measuring a recorded image, such as reflection density, is not linear. Thus, the processing of correcting C, M, Y, K, S multi-valued input gradation levels so that the relationship between C, M, Y, K, S 10-bit input gradation levels and a density level of an image recorded based on the C, M, Y, K, S 10-bit input gradation levels becomes linear is needed. This processing is the output gamma correction processing. The one-dimensional LUT that is used in step S403 will be referred to as an output gamma correction table 403.

In step S404, color shift correction processing is performed. An output gamma correction table that is generated for a recording head having a normal recording characteristic is often used as the output gamma correction table 403 in step S403. However, as described above, each recording head or ejection opening has individual variability in ejection characteristics. Thus, with an output gamma correction table for correcting a recording characteristic of a recording head or ejection opening having a normal ejection characteristic alone, it is not possible to perform density correction as appropriate with respect to every recording head or ejection opening. Thus, in the present exemplary embodiment, color shift correction processing is performed on the C, M, Y, K, S multi-valued data having undergone the output gamma correction so that the amount of each ink to be applied in image recording is determined.

A one-dimensional LUT for color shift correction for use in color shift correction processing is set based on information that is acquired in the calibration process and specifies an ejection characteristic of each ejection opening row. The information that specifies the ejection characteristics is density value information for the color inks (C, M, Y, K) containing a colorant and gloss value information for the clear ink (S) containing no colorant. While the processing of correcting data that specifies an amount of ink as a recording material to be applied is referred to as "color shift correction" in the present specification, the color shift correction is not limited to the cases where predefined data is corrected, and the processing in a case where new determination is performed is also referred to as "color shift correction". Further, the processing of determining an application amount of the clear ink containing no colorant with respect to the ejection characteristic is also referred to as "color shift correction processing" as in the cases of the color inks.

After the color shift correction processing is performed, in step S405, quantization processing is performed, such as halftone processing using error diffusion or dither pattern and index expansion. As a result of the processing, C, M, Y, K, S binary recording data that specifies whether an ink droplet is to be ejected or not ejected from the recording head 5 is generated, and the generated data is output.

(Calibration Process)

Next, the calibration process that is a feature of the present exemplary embodiment will be described below. The calibration process is a process of generating the color shift correction LUT described above and is executed by a user instruction while no image recording is performed. Alternatively, the calibration process can be executed automatically when a predetermined condition is satisfied.

The calibration according to the present exemplary embodiment includes two processes, a process of acquiring density characteristics with respect to the color inks C, M, Y, and K and generating one-dimensional correction LUTs for the color inks and a process of acquiring a gloss value characteristic with respect to the clear ink (S) containing no colorant and generating a one-dimensional correction LUT for the clear ink. A reason therefor will be described below.

First, Japanese Patent Application Laid-Open No. 2017-217891 described above discusses a clear ink calibration method, but the balance of the intensity ratio among three colors that are read changes significantly due to a factor such as a minor error in measurement, so that it is difficult to estimate an amount of ejection of the clear ink with great accuracy. In contrast, according to the present exemplary embodiment, the amount of ejection is estimated from the reflection intensity of specular reflection light of a test pattern for the clear ink.

Figure 6:
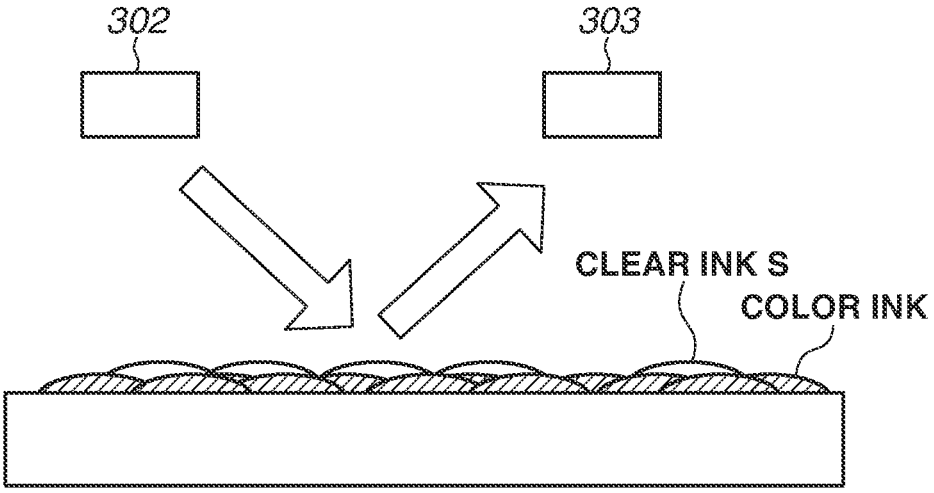
FIG. 6 is a diagram illustrating a configuration of patches for a clear ink.
Figure 11:
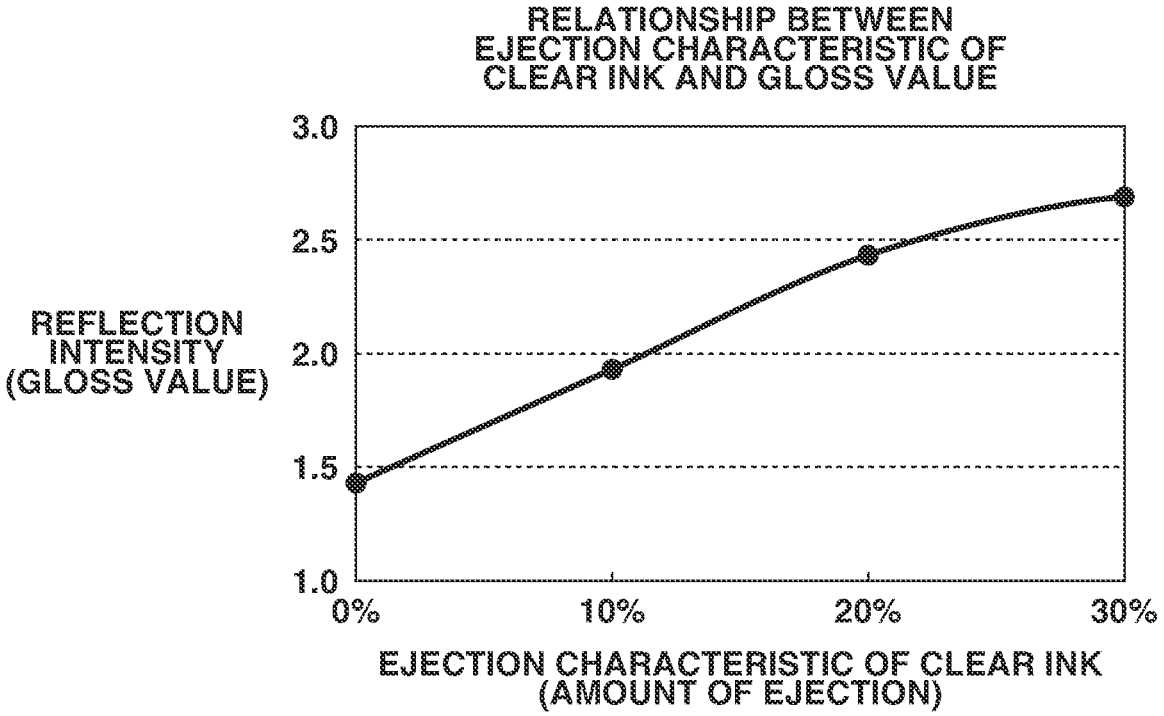
FIG. 11 is a diagram illustrating a relationship between an application amount of a clear ink patch and reflection intensity.

In the acquisition of the gloss value characteristic of the clear ink, the color inks containing a colorant are applied as a background to each patch of the patch pattern for the clear ink (for the clear recording material). FIG. 6 is a cross-sectional view illustrating patches for acquiring the gloss value characteristic of the clear ink. A black ink layer (first layer) recorded using the black (K) ink is formed as a background, and a clear ink layer (second layer) recorded using the clear ink (S) is formed on the black ink layer. FIG. 11 illustrates a measurement result of a patch pattern for the clear ink that uses a color ink layer as an undercoat layer according to the present exemplary embodiment. The horizontal axis shows the application amount of the clear ink and specifies a recording duty when 100% is defined as a case where one ink droplet is applied to one pixel at a resolution of 1200 dpi (dots per inch). The vertical axis shows the reflection intensity (gloss value) acquired from a result of the measurement of the specular reflection light. The graph shows that the result of the measurement of the patch pattern according to the present exemplary embodiment increases one-dimensionally. As described above, the color inks are applied as a background of the patches to increase the amount of change in the measurement results, compared to a case where the patches that are formed using the clear ink alone are measured. This makes it easier to acquire a change that is based on a difference in the application amount of the clear ink.

In the case of using the color inks as a background, it is desirable that the densities of the color inks should be adequate values and that the density characteristics of the color inks should be corrected as appropriate, because if the densities of the color inks used in the undercoat layer vary, even if the same amount of the clear ink is applied onto the color inks, the detected gloss value varies. Thus, in the present exemplary embodiment, before the patch pattern for the clear ink is recorded, the patch patterns for the color inks (for the color recording material) are recorded and the recorded patch patterns are measured, followed by calibration of the color inks. Then, in the calibration of the color inks, the one-dimensional correction LUTs that are generated as information about the application amounts of the color inks are applied to image data (patch data) for recording the patch pattern for the clear ink, and then the patch pattern for the clear ink is recorded. With the above-described configuration, a decrease in calibration accuracy that originates from the ejection characteristics of the color inks applied as a background is reduced in acquisition of the gloss value characteristic of the clear ink.

Figure 7A:
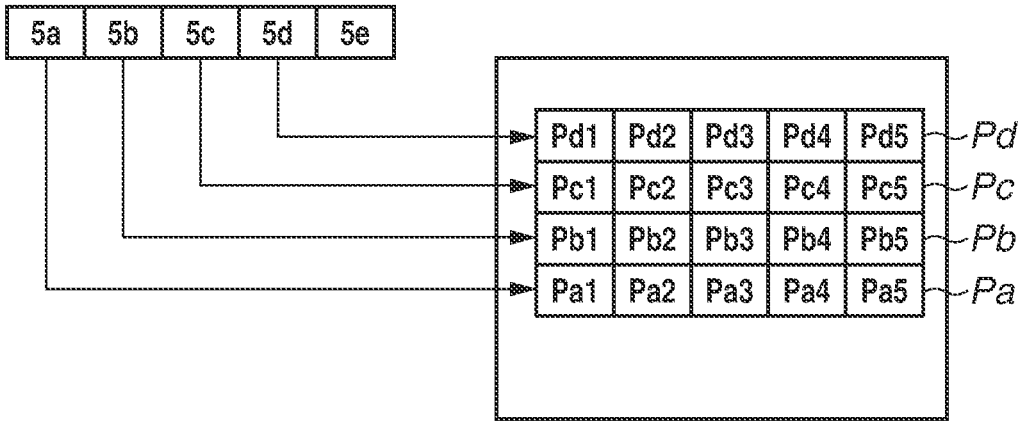
FIGS. 7A and 7B are diagrams each illustrating a patch pattern that is recorded in calibration processing.
Figure 7B:
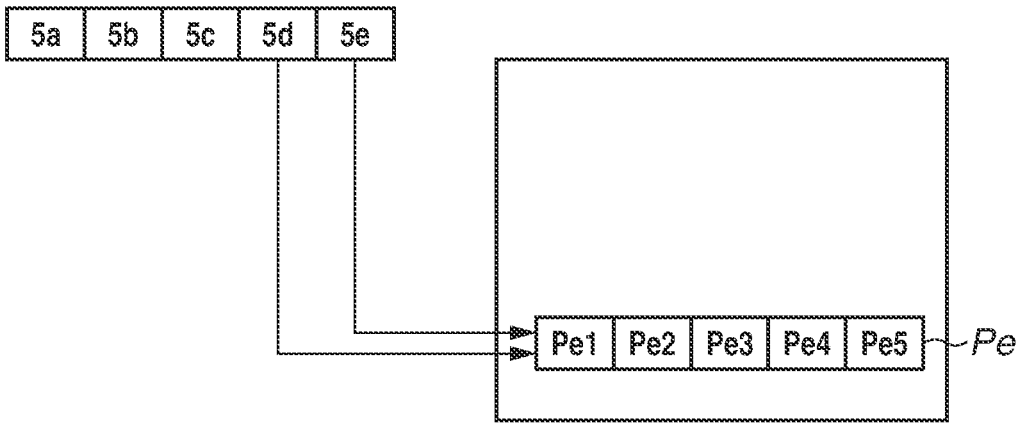

FIGS. 7A and 7B illustrate patch patterns that are recorded in the calibration processing of generating the color shift correction LUTs. FIG. 7A illustrates patches that are recorded with changed gradation values of the respective colors (C, M, Y, K) of the color inks, and FIG. 7B illustrates patches that are recorded with changed gradation values of the patch for the clear ink (S). The alphabetical characters Pa to Pd of the patches indicate that the patches are recorded using the ejection opening rows 5*a* to 5*d* for the color inks, and the alphabetical character Pe of the patches indicates that the patches are recorded using the ejection opening row 5*e* for the clear ink. The numerical characters 1 to 5 of the patches indicate ranks of the density gradations of the recorded patches. For example, Pa1 indicates the patch of the gradation value rank I that is recorded using the ejection opening row 5*a*, and Pe5 indicates the patch of the gradation value rank 5 that is recorded using the ejection opening rows 5*d* and 5*e*. The gradation values 1 to 5 of Pe1 to Pe5 indicate the gradation values of the clear ink (S) ejected from the ejection opening row 5*e*. As described above, the gradation value of the black (K) ink used as a background in the patches Pe1 to Pe5 is constant.

Figure 8:
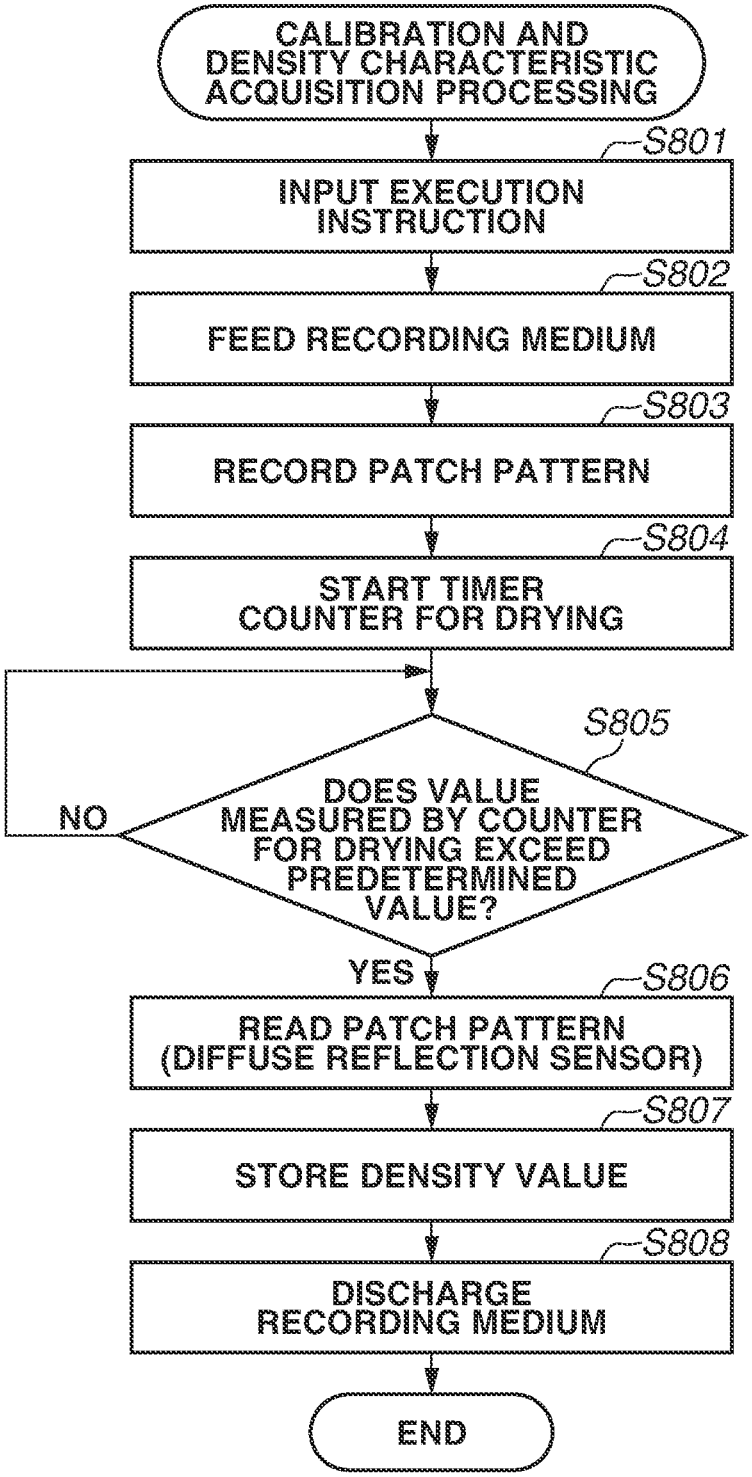
FIG. 8 is a flowchart illustrating a process of color ink calibration.

FIG. 8 is a flowchart illustrating a process of acquiring the density characteristics of the recording apparatus 200 with respect to the color inks C, M, Y, and K. In step S801, an instruction to start calibration for recording a patch pattern and acquiring the density characteristics of the color inks is input via an input unit or a CPU of the host apparatus 100 or the operation panel 22 of the recording apparatus 200. If an instruction to execute calibration processing is input, then in step S802, the CPU 20*a* of the recording apparatus 200 drives the sheet feeding roller driving motor 24 and starts feeding the recording medium 1 from a sheet feeding tray. If the recording medium 1 is conveyed to a region where the recording head 5 can perform recording, then in step S803, the patch pattern for acquiring the density characteristics of the color inks as illustrated in FIG. 7A is recorded. In the present exemplary embodiment, the conveyance operation of conveying the recording medium 1 in the sheet conveyance direction and the recording and scanning operation of driving the carriage driving motor 2 and causing the carriage 6 to scan in the scan direction are alternately performed to record the patch pattern.

In step S804, a timer counter is started to wait for a predetermined period of time so that the recorded patch pattern is dried. In step S805, in a case where the timer counter indicates that the predetermined period of time passes (YES in step S805), then in step S806, the measurement of the reflection intensity of the patch pattern is started using the diffuse reflection sensor 311 of the multi-purpose sensor 102. The reflection intensity is measured by sequentially turning on the LEDs of the light emitting portion 304 of the multi-purpose sensor 102 that correspond to the density measurement target ink colors and then reading reflection light (diffusion light) using the light receiving portion 303. For example, the green (G) LED is turned on in measuring the patch pattern recorded using the magenta (M) ink and a white portion (white) of the sheet where no patch pattern is recorded. The blue (B) LED is turned on in measuring the patch pattern recorded using the yellow (Y)

ink and the black (K) ink and the white portion (white) of the sheet where no patch pattern is recorded. The red (R) LED is turned on in measuring the patch pattern recorded using the cyan (C) ink and the white portion (white) of the sheet where no patch pattern is recorded. The measurement results of the white portion (white) of the sheet are used as a reference value in calculating the density values of the patch patterns recorded using the color inks.

If the reading of the patch patterns is finished, then in step S807, the density value of the patch pattern for each corresponding ejection opening row is calculated based on the measurement values of the respective patches and the measurement values of the white portion of the sheet. The calculated density values are stored in the RAM 20*b* in a main body of the recording apparatus 200. In step S808, the recording medium 1 is discharged, and the process is ended.

Next, the one-dimensional correction LUTs for color shift correction of the color inks are generated based on the density characteristics of the color inks that are acquired through the process illustrated in FIG. 8. The one-dimensional correction LUTs to be generated are the color ink portion (four colors C, M, Y, and K in the present exemplary embodiment) of the one-dimensional correction LUT that is used in the color shift correction processing in step S404 in FIG. 5 described above. The one-dimensional correction LUTs are generated by comparing the density values acquired by measuring the patches illustrated in FIG. 7A with predetermined target densities (hereinafter, referred to as "target values"). An output value with respect to an input value is set so that the densities of the image recorded on the recording medium 1 are corrected to the target values. The target values can be density values that are acquired by reading patch patterns recorded in advance using an inkjet recording apparatus with great accuracy. The target values are values that are very close to ideal values.

Figure 10A:
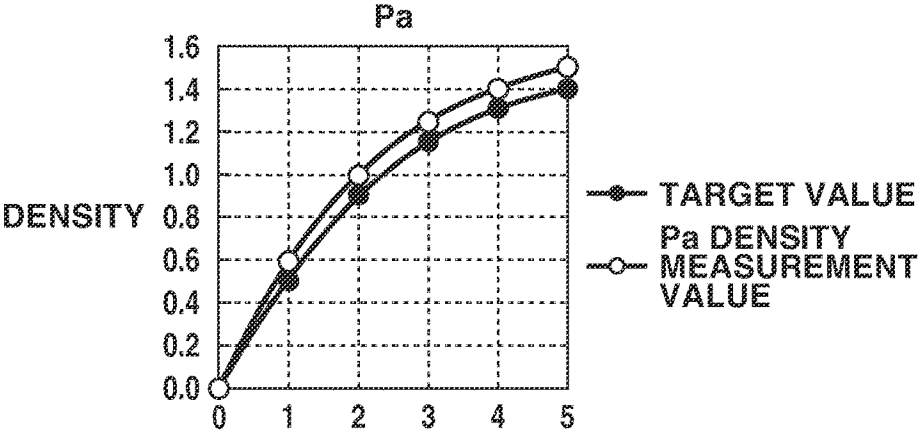
FIGS. 10A, 10B, 10C, and 10D are diagrams illustrating measurement results and generated correction lookup tables (LUTs).
Figure 10B:
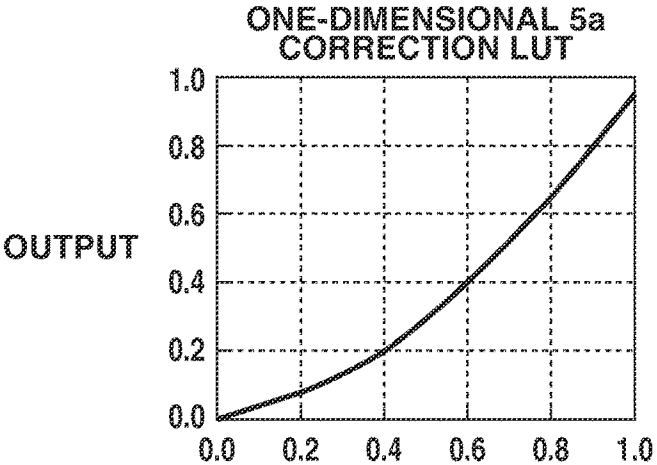

FIGS. 10A to 10D illustrate a one-dimensional LUT 404 for color shift correction that is the generated one-dimensional LUT. FIG. 10A is a graph that illustrates the density values acquired by reading the patch pattern Pa including the patches Pa1 to Pa5 recorded using the ejection opening row 5*a* for the cyan ink and the target values. FIG. 10B is a graph that illustrates a one-dimensional LUT for color shift correction of the cyan ink that is generated based on the values specified in FIG. 10A. In this example, since the read density values are higher than the target values, the one-dimensional LUT is generated so that output values are lower than input values with respect to image data to be recorded using the ejection opening row 5*a*. Similarly, a one-dimensional LUT for color shift correction of the magenta ink is generated based on the density values acquired by reading the patch pattern Pb including the patches Pb1 to Pb5 recorded using the ejection opening row 5*b* for the magenta ink and the target values. Similarly, a one-dimensional LUT for color shift correction of the yellow ink and a one-dimensional LUT for color shift correction of the black ink are generated.

Next, a process of acquiring the gloss value characteristic of the recording apparatus 200 with respect to the clear ink S will be described below with reference to FIG. 9. In step S901, an instruction to start calibration to record a patch pattern and measure the gloss value of the clear ink (S) is input via the input unit or the CPU of the host apparatus 100 or the operation panel 22 of the recording apparatus 200. If an instruction to execute calibration processing is input, then in step S902, the CPU 20*a* of the recording apparatus 200 drives the sheet feeding roller driving motor 24 and starts feeding the recording medium 1 from the sheet feeding tray. If the recording medium 1 is conveyed to the region where the recording head 5 can perform recording, then in step S903, the patch pattern for acquiring the gloss value characteristic of the clear ink as illustrated in FIG. 7B is recorded. In the present exemplary embodiment, the conveyance operation of conveying the recording medium 1 in the sheet conveyance direction and the recording and scanning operation of driving the carriage driving motor 2 and causing the carriage 6 to scan in the scan direction are alternately performed to record the patch pattern. As described above, the patch pattern for acquiring the gloss value characteristic is a patch generated by forming a clear ink layer on a black ink layer of a background. As described above, the one-dimensional correction LUTs for color shift correction of the color inks that are generated through the process illustrated in FIG. 8 are applied to the patch data for recording the patch pattern for the clear ink. Thus, a color shift in the black ink image recorded as the background is corrected, so that the effect of the ejection characteristic of the black ink is reduced.

In step S904, the timer counter is started to wait for a predetermined period of time so that the recorded patch pattern is dried. In step S905, in a case where the timer counter indicates that the predetermined period of time passes (YES in step S905), then in step S906, the measurement of the reflection intensity of the patch pattern is started using the specular reflection sensor 310 of the multi-purpose sensor 102. The reflection intensity is measured by turning on the LED of the light emitting portion 302 of the multi-purpose sensor 102 and then reading reflection light (specular reflection light) using the light receiving portion 303. In the present exemplary embodiment, one of the LEDs R, G, and B is used.

If the reading of the patch patterns is finished, then in step S907, the gloss value of the patch pattern for each corresponding ejection opening row is calculated based on the measurement values of the respective patches. The calculated gloss values are stored in the RAM 20*b* in the main body of the recording apparatus 200. Thereafter, in step S908, the recording medium 1 is discharged, and the process is ended.

Figure 9:
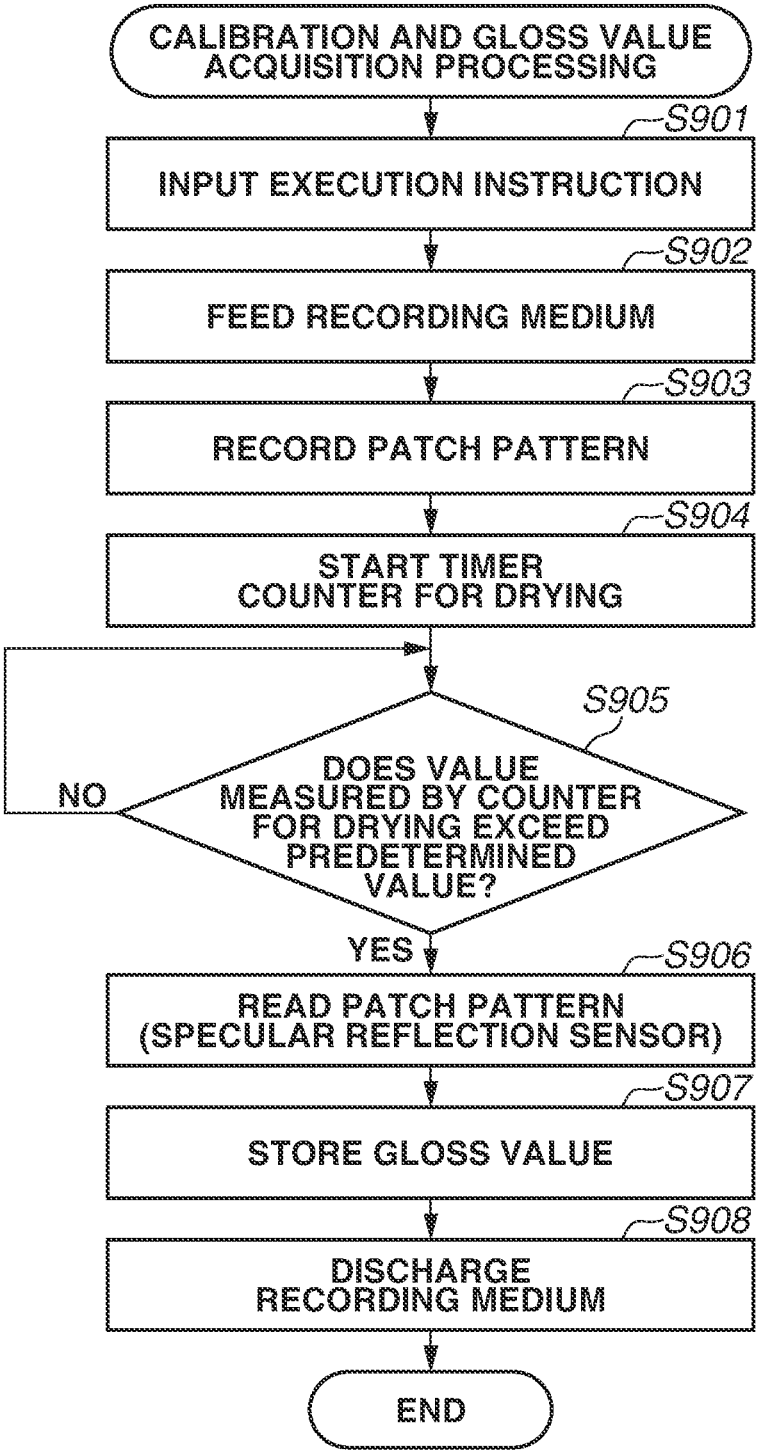
FIG. 9 is a flowchart illustrating a process of clear ink calibration.

Next, the one-dimensional correction LUT for color shift correction of the clear ink is generated based on the gloss value characteristic of the clear ink that is acquired through the process illustrated in FIG. 9. The one-dimensional correction LUT to be generated is the clear ink (S) portion of the one-dimensional correction LUT that is used in the color shift correction processing in step S404 in FIG. 5 described above. The one-dimensional correction LUT is generated by comparing the gloss values acquired by reading the patch pattern with predetermined target gloss values (hereinafter, referred to as "target values"), which is similar to the methods used to generate the one-dimensional correction LUTs for the color inks.

Figure 10C:
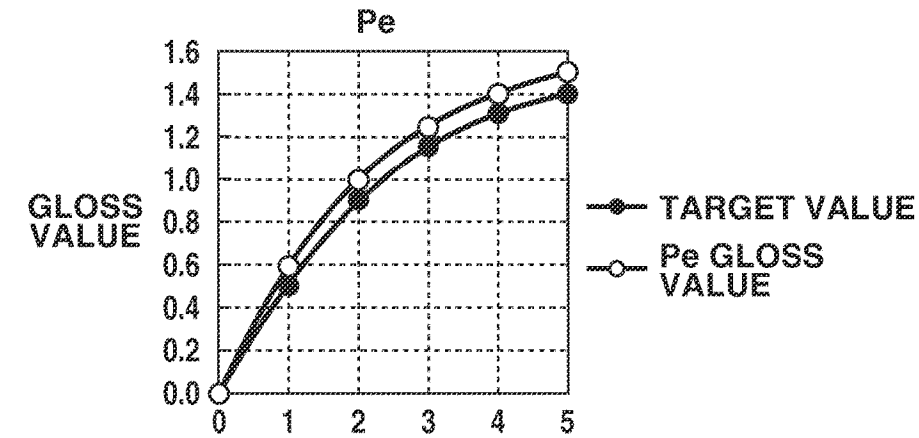
Figure 10D:
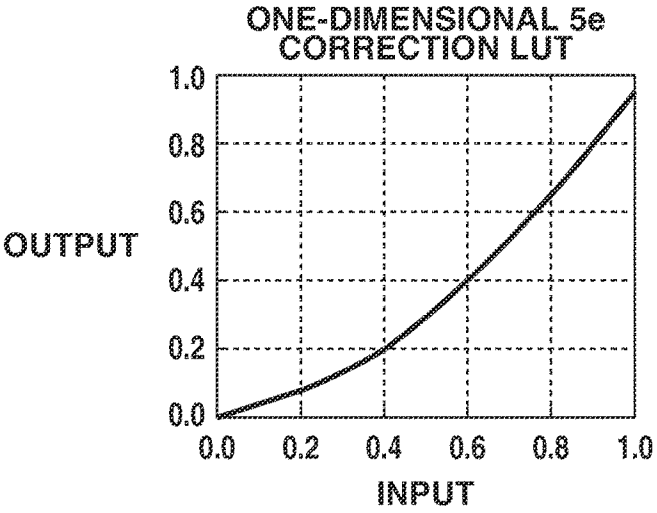

FIG. 10C is a graph that illustrates the gloss values acquired by reading the patch pattern Pe including the patches Pe1 to Pe5 recorded with changed gradation values of the clear ink and the target values. FIG. 10D is a graph that illustrates a one-dimensional LUT for color shift correction of the clear ink that is generated based on the values specified in FIG. 10C. In this example, since the read gloss values are higher than the target values, the one-dimensional LUT is generated so that output values are lower than input values with respect to image data to be recorded using the ejection opening row 5*e*.

In the present exemplary embodiment, one of the LEDs R, G, and B of the light emitting portion 302 of the multi-purpose sensor 102 is turned on to emit light and the reflection intensity of the specular reflection light is read in the acquisition of the gloss value characteristic from the patch pattern for the clear ink. This is based on the finding of the studies by the present inventors that the difference in the application amount of the clear ink can be acquired with great accuracy from the reflection intensity of the specular reflection light. In conventionally-known methods, an amount of ejection is estimated based on a balance of an intensity ratio of specular reflection light as discussed in Japanese Patent Application Laid-Open No. 2017-217891, or an amount of ejection is estimated from a spectral reflectance by acquiring a measurement target color from a result of measuring specular reflection light and estimating an ejection characteristic of a clear ink from the acquired color. In the method of estimating an ejection characteristic from a color of reflection light, however, it is difficult to realize high measurement accuracy, because the reflection light sometimes exhibits similar colors even if there is a significant difference in the application amount of the clear ink. Furthermore, it is also difficult to realize reproducibility in measurement. On the contrary, in the case where the application amount of the clear ink is acquired from the reflection intensity of the specular reflection light according to the present exemplary embodiment, the relationship between the application amount of the clear ink and the reflection intensity is a one-dimensional proportional relationship as illustrated in FIG. 11. Thus, the relationship between the reflection intensity and the application amount of the clear ink is definite, so that the application amount is estimated with greater accuracy than that in the method of estimating the application amount of the clear ink from the color of the reflection light. There are also advantages that a sensor that is necessary for the measurement is only at least one LED in the light emitting portion and that no measurement system for measuring the spectral reflectance is needed.

As described above, in the present exemplary embodiment, the patch pattern with the color inks applied as an undercoat layer under the clear ink layer is recorded in the calibration for correcting the gloss value characteristic of the clear ink. Then, the reflection intensity of the specular reflection light of the patch pattern for the clear ink is acquired using the specular reflection sensor 310, and the LUT for color shift correction of the clear ink is generated from the reflection intensity. With this configuration, the application amount of the clear ink can be corrected with greater accuracy than that in the method of estimating the application amount of the clear ink from the color of a patch.

Furthermore, before the patch pattern for the clear ink is recorded, the color inks to be applied as an undercoat layer are calibrated, and correction LUTs for the color ink are generated. Then, the generated correction LUTs for the color inks are applied to data for recording a color ink layer for use as a background of the patch pattern for the clear ink. In this way, the effect of the ejection characteristics of the color inks is reduced in the calibration of the clear ink.

It is desirable to record the patch patterns for the color inks to be used as a background and generate the one-dimensional correction LUTs using measurement values of the patch patterns immediately before the patches for the clear ink are recorded. It is also desirable not to record an image based on other image data between the recording of the patch patterns for the color inks and the recording of the patch pattern for the clear ink. As long as the patch pattern for the clear ink is to be recorded after the patch patterns for the color inks are measured, the patch patterns for the color inks and the patch pattern for the clear ink can be recorded on the same recording medium.

Further, it is more desirable to generate the one-dimensional LUTs for color shift correction for each condition such as a recording medium, resolution, and use environment. Further, the above-described calibration processing can be executed each time an image recording instruction job is received, or the one-dimensional correction LUTs that are generated in previous execution can be stored in a memory and the stored LUTs can be used. Further, the one-dimensional LUTs for color shift correction can be selected from a plurality of stored tables and the selected LUTs can be set.

While the black ink, which is an achromatic color, is used as a background of the patch pattern for the clear ink in the present exemplary embodiment, the background is not limited to the black ink and any color ink can be used. In order to calibrate the clear ink with great accuracy, the density of the image of the color ink layer recorded as an undercoat layer is desirably high. An optical density (OD) value that is an optical density in measuring the undercoat layer is desirably 0.5 or greater, more desirably 1.0 or greater. In the case where the black ink, which is an ink of an achromatic colorant, is used as an undercoat layer, the LED to be used in measuring the patch pattern for the clear ink can be an LED of any color. Meanwhile, in a case where a color ink such as the color ink C, M, or Y is used as an undercoat layer, it is desirable to measure using a color LED having a color that is at least 90 degrees apart from the color of the color ink in a hue circle.

In the first exemplary embodiment described above, the example in which the one-dimensional LUTs for color shift correction of the color inks are generated from the density values read from the patch patterns formed using the color inks using the diffuse reflection sensor 311 is described. In a second exemplary embodiment, an example in which one-dimensional LUTs for color shift correction of the color inks are generated from density values read from patch patterns formed by applying the color inks and the clear ink will be described below.

Figure 12A:
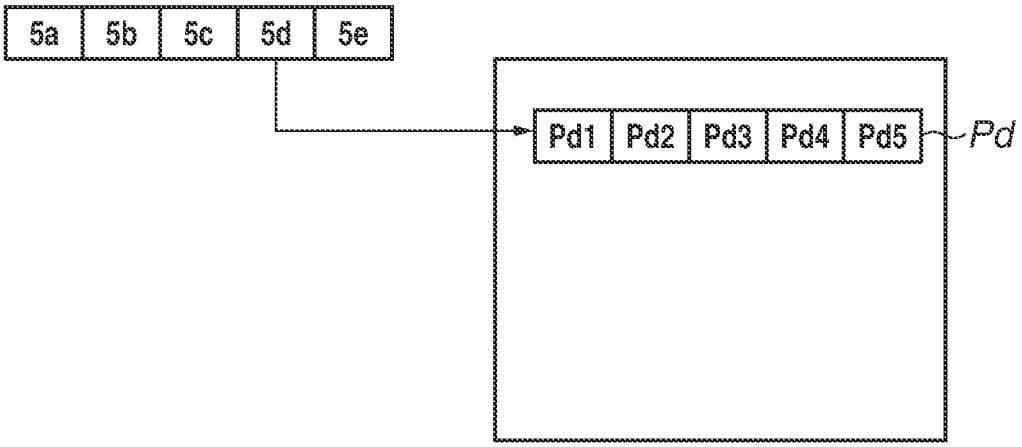
FIGS. 12A, 12B and 12C are diagrams each illustrating a patch pattern according to a second exemplary embodiment.
Figure 12B:
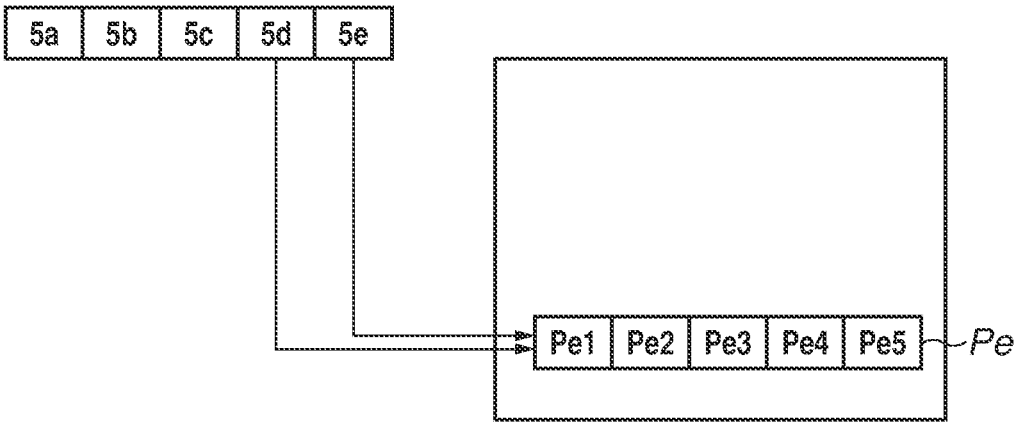
Figure 12C:
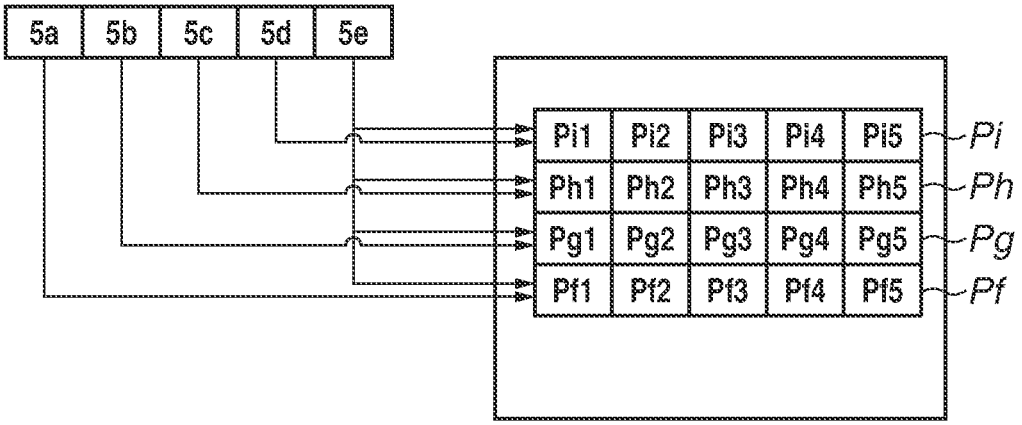

FIGS. 12A to 12C illustrate patch patterns that are recorded in the calibration processing of generating the color shift correction LUTs according to the present exemplary embodiment. FIG. 12A illustrates patches that are recorded using the black ink as a color ink with changed gradation values for the purpose of acquiring a density characteristic of the black ink. FIG. 12B illustrates patches that are recorded using the black ink and the clear ink with a constant gradation value of the black ink and with changed gradation values of the clear ink for the purpose of acquiring a gloss value characteristic of the clear ink. FIG. 12C illustrates patches that are recorded with changed gradation values of the respective colors of the color inks (four colors C, M, Y, and K) for the purpose of acquiring density characteristics of the respective color inks. The alphabetical character Pd of each patch indicates that the patch is recorded using the ejection opening row for the black ink, and the alphabetical character Pe of each patch indicates that the patch is recorded using the ejection opening row 5*e* for the clear ink. The alphabetical character Pf of each patch indicates that the patch is recorded using the ejection opening row 5*a* for the cyan ink and the ejection opening row 5*e* for the clear ink. Similarly, the alphabetical character Pg of each patch indicates that the patch is recorded using the ejection opening row 5*b* for the magenta ink and the ejection opening row Se for the clear ink. The alphabetical character Ph of each patch indicates that the patch is recorded using the ejection opening row 5*c* for the yellow ink and the ejection opening row 5*e* for the clear ink. The alphabetical character Pi of each patch indicates that the patch is recorded using the ejection opening row 5*d* for the black ink and the ejection opening row Se for the clear ink. The numerical characters 1 to 5 of the patches indicate ranks of the density gradations of the recorded patches. The gradation values of the patches Pe are gradation values with respect to the clear ink (S), and the gradation value with respect to the black ink is constant. Similarly, the gradation values of the patches Pf, Pg, Ph, and Pi are gradation values with respect to the respective colors (C, M, Y, and K) of the color inks, and the gradation value of the clear ink is constant.

In the present exemplary embodiment, the patches recorded using both the clear ink (S) and the color ink (one of the colors C, M, Y, and K) are formed also by applying the clear ink onto the color ink.

In the present exemplary embodiment, first, a patch pattern is recorded using one color (black ink in the present exemplary embodiment) among the color inks, and calibration is performed, and a correction LUT with respect to the ejection characteristic of the black ink is generated (FIG. 12A). In the present exemplary embodiment, densities are measured using the diffuse reflection sensor 311. Then, after the generated correction LUT for the black ink is applied, the black ink is used as an undercoat layer, and the clear ink is calibrated, and then a correction LUT with respect to the ejection characteristic of the clear ink is generated (FIG. 12B). In the present exemplary embodiment, gloss values are measured using the specular reflection sensor 310. Then, after the generated correction LUT for the clear ink is applied, all the color inks (C, M, Y. K) are calibrated, and correction LUTs with respect to the ejection characteristics of the respective colors of the color inks are generated (FIG. 12C). In the present exemplary embodiment, densities are measured using the diffuse reflection sensor 311. Since the process of executing the calibration and the method of generating the one-dimensional correction LUTs are similar to those in the first exemplary embodiment, detailed description thereof is omitted.

As described above, in the present exemplary embodiment, the clear ink is calibrated after the color ink that is to be used as an undercoat layer is calibrated as in the first exemplary embodiment. The difference from the first exemplary embodiment is that after the clear ink is calibrated, the color inks are calibrated. The patches having the clear ink layer formed on the color ink layer is used in the calibration of the color inks. In this way, the color inks are calibrated in a state that is similar to real recording in which the clear ink is applied onto the color inks.

In the present exemplary embodiment, since the black ink is used as an undercoat layer, the black ink is calibrated before the clear ink is calibrated. Then, after the clear ink is calibrated, the color inks of all the colors are calibrated using the patches to which the clear ink is applied. In a case where a color other than the black ink is used as an undercoat layer, it is desirable to calibrate the ink of the color before the clear ink is calibrated. Although it is desirable to calibrate the color inks of all the colors using the patches to which the clear ink is applied after the clear ink is calibrated, the ink that is used as a background of the clear ink does not have to be thusly calibrated, because the ink is already calibrated.

In the first and second exemplary embodiments described above, the examples in which the one-dimensional LUTs for color shift correction of the color inks are generated from the density values of the patch patterns using the diffuse reflection sensor 311 are described. In a third exemplary embodiment, an example in which one-dimensional LUTs for color shift correction of the color inks are generated from gloss values acquired by measuring patch patterns using the specular reflection sensor 310 will be described below.

Figure 13A:
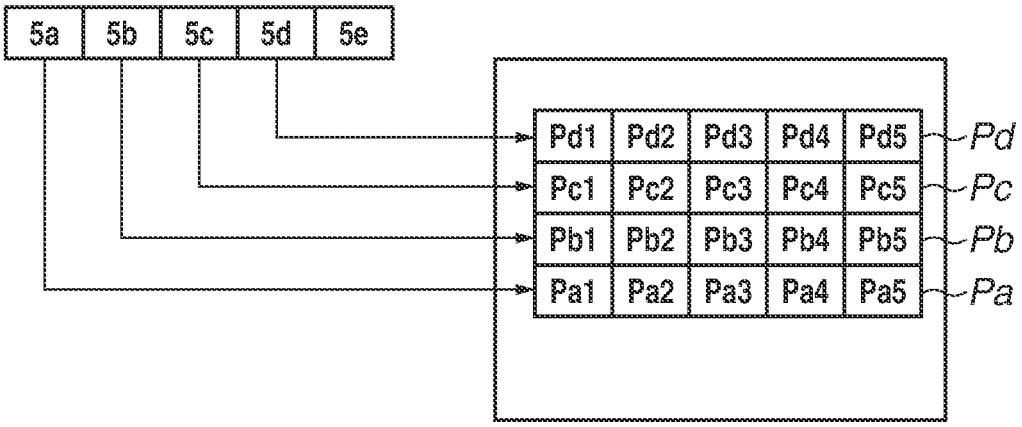
FIGS. 13A, 13B, and 13C are diagrams each illustrating a patch pattern according to a third exemplary embodiment.
Figure 13B:
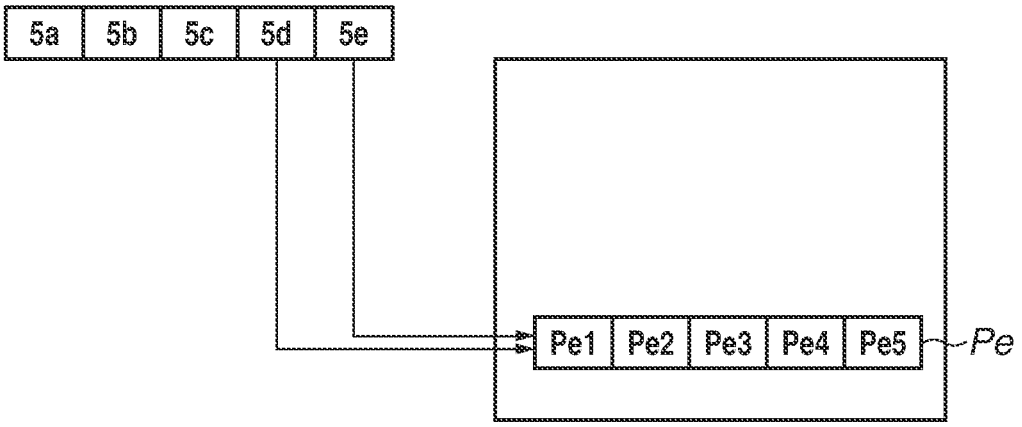
Figure 13C:
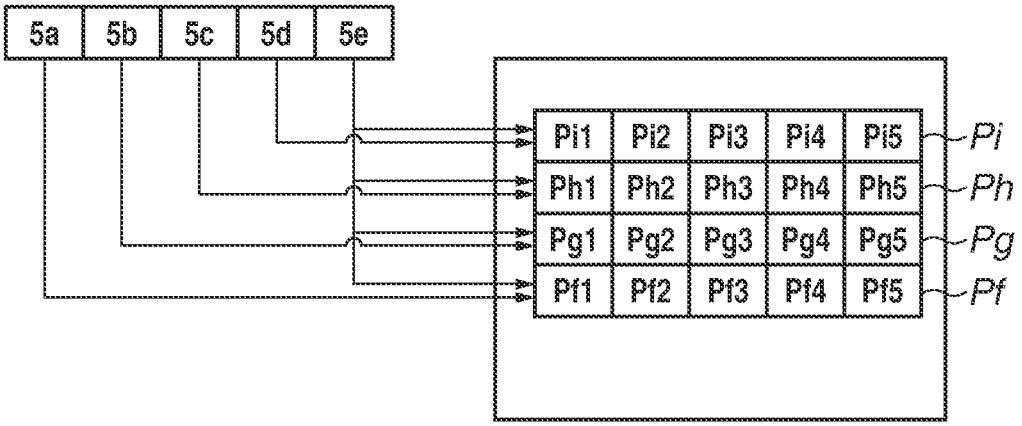

FIGS. 13A to 13C illustrate patch patterns that are recorded in the calibration processing of generating the color shift correction LUTs in the present exemplary embodiment. FIG. 13A illustrates patches that are recorded using the color inks (four colors C, M, Y, and K) with changed gradation values of the respective colors for the purpose of acquiring density characteristics of the respective color inks. FIG. 13B illustrates patches that are recorded using the black ink and the clear ink with a constant gradation value of the black ink and with changed gradation values of the clear ink for the purpose of acquiring a gloss value characteristic of the clear ink. FIG. 13C illustrates patches that are recorded with changed gradation values of the respective colors of the color inks (four colors C, M, Y, and K) for the purpose of acquiring gloss value characteristics of the respective patches. The alphabetical characters Pa to Pd of patches indicate that the patches are recorded using the ejection opening rows 5*a* to 5*d* for the color inks C, M, Y, and K, and the alphabetical character Pe of patches indicates that the patches are recorded using the ejection opening row 5*e* for the clear ink. Further, the alphabetical character Pf of patches indicates that the patches are recorded using the ejection opening row 5*a* for the cyan ink and the ejection opening row 5*e* for the clear ink. Similarly, the alphabetical character Pg of patches indicate that the patches are recorded using the ejection opening row 5*b* for the magenta ink and the ejection opening row 5*e* for the clear ink. The alphabetical character Ph of patches indicate that the patches are recorded using the ejection opening row 5*c* for the yellow ink and the ejection opening row 5*e* for the clear ink. The alphabetical character Pi of patches indicate that the patches are recorded using the ejection opening row 5*d* for the black ink and the ejection opening row 5*e* for the clear ink. The numerical characters 1 to 5 of the patches indicate ranks of the density gradations of the recorded patches. The gradation values of the patches Pe are gradation values with respect to the clear ink (S), and the gradation value with respect to the black ink is constant. Similarly, the gradation values of the patches Pf, Pg, Ph. and Pi are gradation values with respect to the respective colors (C, M, Y, and K) of the color inks, and the gradation value of the clear ink is constant.

In the present exemplary embodiment, the patches recorded using both the clear ink (S) and the color ink (one of the colors C, M, Y, and K) are formed also by applying the clear ink onto the color ink.

In the present exemplary embodiment, first, patch patterns are recorded using the color inks of all the colors (four colors C, M, Y, and K), and calibration is performed, and correction LUTs with respect to the ejection characteristics of the color inks of the respective colors are generated (FIG. 13A). In the present exemplary embodiment, densities are measured using the diffuse reflection sensor 311. Then, after the generated correction LUTs of the color inks are applied, the black ink is used as an undercoat layer, and the clear ink is calibrated, and a correction LUT with respect to the ejection characteristic of the clear ink is generated (FIG. 13B). In the present exemplary embodiment, the gloss values are measured using the specular reflection sensor 310. Then, after the generated correction LUTs of the clear inks are applied, the color inks of all the colors (C, M, Y, K) are calibrated, and correction LUTs with respect to the ejection characteristics of the color inks of the respective colors are generated (FIG. 13C). In the present exemplary embodiment, the gloss values are measured using the specular reflection sensor 310. Since the process of executing the calibration and the method of generating the one-dimensional correction LUTs are similar to those in the first exemplary embodiment, detailed description thereof is omitted.

As described above, in the present exemplary embodiment, when the color inks are calibrated, the patches with the clear ink layer formed by applying the clear ink on the color ink layer are recorded, and the gloss values of the recorded patches are measured. Then, the one-dimensional LUTs for color shift correction are generated based on the measured gloss values. With this configuration, the correction LUTs can be generated from the gloss values based on the measurement results of the specular reflection light.

In the first to third exemplary embodiments described above, the examples in which the color shift correction processing is executed on the clear ink using the one-dimensional LUTs for color shift correction are described. In a fourth exemplary embodiment, a method of generating data for applying the clear ink using a thinning mask based on quantized color ink data will be described below.

Figure 14:
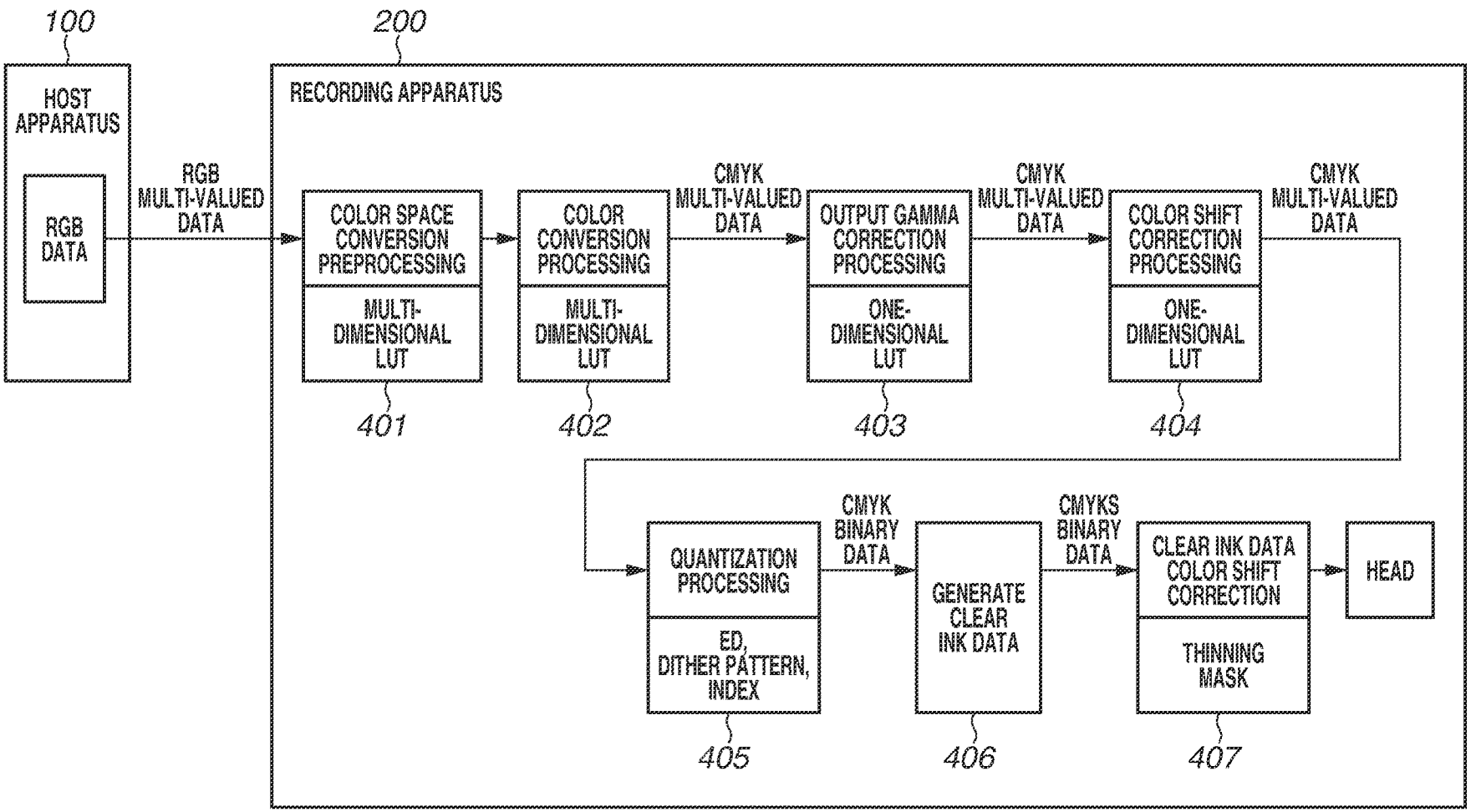
FIG. 14 is a block diagram illustrating an image processing configuration according to a fourth exemplary embodiment.

FIG. 14 is a block diagram illustrating a configuration of image processing according to the present exemplary embodiment. The configuration of image processing according to the present exemplary embodiment is different from the configuration of image processing according to the first exemplary embodiment in FIG. 5 in that data to be output by the color conversion processing in step S402 is C, M, Y, K multi-valued data and multi-valued data on the clear ink (S) is not generated. Then, data for the clear ink is generated based on the C, M, Y, K binary data having undergone the quantization processing in step S405. The binary data for the clear ink is generated by, for example, generating a logical sum of the C, M, Y, K binary data and thinning the generated logical sum with the application amount of the clear ink taken into consideration. In this process, the ejection characteristic of the clear ink is not taken into consideration. Thereafter, in step S407, clear ink color shift correction thinning processing is performed using the thinning mask to thin the binary data for the clear ink based on the ejection characteristic of the clear ink. The thinning mask for thinning the binary data for the clear ink is set based on the gloss value characteristic of the ejection opening row for the clear ink that is acquired in the clear ink calibration processing in the above-described exemplary embodiments.

Figure 15A:
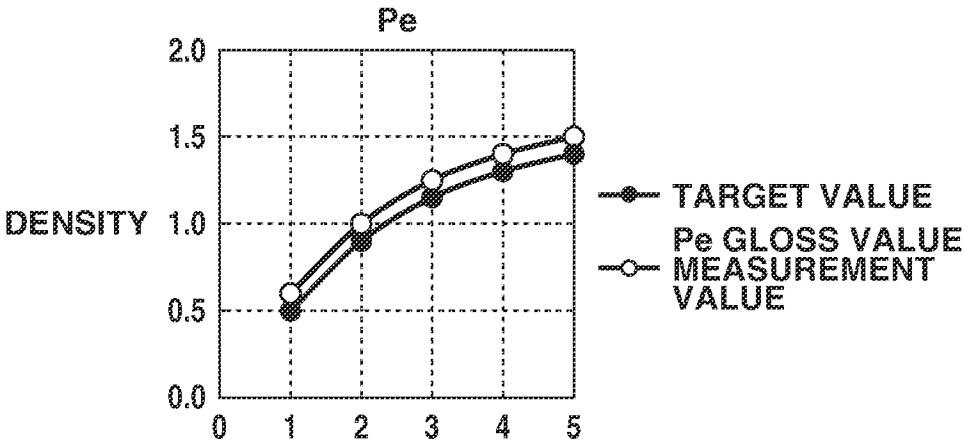
FIGS. 15A and 15B are diagrams illustrating a process of generating a thinning mask.
Figure 15B:
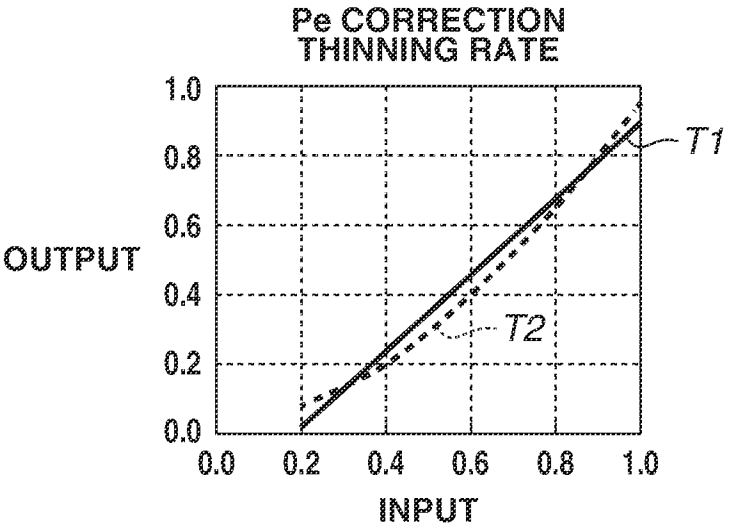

FIGS. 15A and 15B illustrate a process of generating the thinning mask for use in the clear ink color shift correction thinning processing in step S407. FIG. 15A illustrates the density values acquired by reading the patch pattern Pa including the patches Pa1 to Pa5 recorded using the ejection opening row 5*a* and the target values. FIG. 15B illustrates a one-dimensional LUT for color shift correction with respect to the ejection opening row 5*a*. T1 denotes a one-dimensional LUT for color shift correction with respect to the ejection opening row 5*a* that is generated based on the measurement results illustrated in FIG. 15A, and T2 denotes a correction rate that is generated by calculating a fitted curve of T1. The correction rate T2 is obtained by thinning a solid image using the generated thinning mask. The data for the color inks is thinned using the thinning mask to generate application data for applying the clear ink. With this configuration, clear ink application data can be generated from the multi-valued data for the color inks that has undergone the quantization processing.

While the one-dimensional correction LUTs are generated as correction information for correcting the application amount in the above-described exemplary embodiments, the present disclosure is not limited to the form of a lookup table. Alternatively, the correction information can be held in the form of a mathematical function. While the inks are used as recording materials that are applied to recording mediums in the above-described exemplary embodiments, the recording materials are not limited to those described above. A color toner can be used as a color recording material besides the color inks, and a clear toner can be used as a clear recording material besides the clear ink.

As an alternative to a clear recording material, a reaction solution which reacts with a colorant contained in a color ink can be used. The reaction solution reacts with a colorant and the colorant flocculates. In a case of applying the reaction solution, it is desirable that the reaction solution is applied before application of a color ink or is applied together with a color ink. More specifically, for example, a color ink layer is formed by applying a color ink to form a patch on a reaction solution layer formed using the reaction solution, or the reaction solution and a color ink are applied together in a scan to form a layer in which the reaction solution and the color ink is mixed. Similar to the case using a clear ink, a plurality of patches each having a different application amount of the reaction solution is formed and gloss values of the patches are measured. With this configuration, an amount of ejection of the reaction solution is estimated so that a correction table can be generated, as in the case using a clear ink.

While the patch patterns including the plurality of patches are recorded in the above-described exemplary embodiments, the recording is not limited to that described above, and any configuration by which one or more patches are recorded can be employed. The correction value determination is not limited to the configuration by which correction values are determined using the target values, and a configuration can be employed by which an amount of ejection is estimated based on measurement results of a plurality of patches of different application amounts of the clear ink and correction values are determined. Depending on a material contained in the clear ink, a gloss value of a recorded image is not always increased by an increase in the application amount, and when the clear ink covers a recording medium to some extent, further application of the clear ink does not always increase the gloss value. This characteristic can be used to estimate an amount of ejection based on measurement results of gloss values of a plurality of patches of different application amounts.

OTHER EMBODIMENTS

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-019200, filed Feb. 5, 2019, which is hereby incorporated by reference herein in its entirety.

What is claimed is:

1. An image recording apparatus comprising:

a recording unit configured to apply a clear recording material to a recording medium;

a controller configured cause the recording unit to record a test pattern by forming a second layer of the clear recording material containing no colorant on a first layer formed on the recording medium, the first layer being a layer of a color recording material containing a colorant;

an acquisition unit configured to acquire a reflection intensity of specular reflection light of the test pattern;

a memory configured to store a target reflection intensity with respect to the application amount of the clear recording material; and a generation unit configured to generate calibration data for calibrating an application amount of the clear recording material, based on the reflection intensity acquired by the acquisition unit and the target reflection intensity of the specular reflection light stored in the memory.

2. The image recording apparatus according to claim 1, wherein the test pattern includes a plurality of patches different from each other in an amount of the clear recording material applied per unit area, and wherein the acquisition unit acquires the reflection intensity for each of the plurality of patches.

3. The image recording apparatus according to claim 1, wherein the acquisition unit acquires a reflection intensity of specular reflection light of illumination light from one of a red (R) light emitting portion, a green (G) light emitting portion, and a blue (B) light emitting portion.

4. The image recording apparatus according to claim 1, further comprising a second recording unit configured to apply a color recording material to a recording medium, wherein before recording the test pattern, the controller causes the second recording unit to records a test pattern by applying the color recording material to recording medium, the image recording apparatus further comprising:

a second generation unit configured to generate second calibration data for calibrating an application amount of the color recording material, based on a measurement result of the second test pattern; and a color-calibration unit configured to calibrate the application amount of the color recording material for forming the first layer of the test pattern, based on the second calibration data and a target value of the application amount of the color material stored in the memory, wherein the controller causes the recording unit to forms the first layer of the test pattern, based on the application amount of the color recording material calibrated by the color-calibration unit.

5. The image recording apparatus according to claim 4, wherein the second test pattern includes a plurality of patches different from each other in the application amount of the color recording material applied per unit area.

6. The image recording apparatus according to claim 4, wherein the measurement result of the second test pattern is a reflection intensity of diffusion light of the second test pattern for the color recording material.

7. The image recording apparatus according to claim 4, wherein after recording the second test pattern, the second recording unit does not record an image based on other image data before recording the test pattern.

8. The image recording apparatus according to claim 1, wherein an optical density (OD) value in measuring the first layer is 0.5 or greater.

9. The image recording apparatus according to claim 1, wherein an optical density (OD) value in measuring the first layer is 1.0 or greater.

10. The image recording apparatus according to claim 1, wherein the colorant contained in the color recording material is an achromatic colorant.

11. The image recording apparatus according to claim 1, wherein the recording unit includes a recording element configured to apply the clear recording material, and wherein the second recording unit includes a recording element configured to apply the color recording material.

12. The image recording apparatus according to claim 1, wherein the color recording material and the clear recording material are an ink.

13. The image recording apparatus according to claim 1, wherein the acquisition unit includes a sensor configured to acquire a reflection intensity of specular reflection light emitted from one of a red (R) light emitting portion, a green (G) light emitting portion, and a blue (B) light emitting portion.

14. The image recording apparatus according to claim 1, wherein the calibration data is one-dimensional data for outputting an output value to an input of a gradation value corresponding to the clear recording material.

15. The image recording apparatus according to claim 1, wherein the calibration data is data for calibrating a difference of the application amount of the clear recording material due to individual variability in ejection characteristics of the recording unit.

16. The image recording apparatus according to claim 1, further comprising a calibration unit configured to calibrate the application amount of the clear recording material based on the calibration data.

17. An information processing method comprising:

applying a clear recording material to a recording medium;

recording a test pattern by forming a second layer of the clear recording material containing no colorant on a first layer formed on the recording medium, the first layer being a layer of a color recording material containing a colorant;

acquiring a reflection intensity of specular reflection light of a test pattern;

storing a target reflection intensity with respect to the application amount of the clear recording material in a memory; and generating calibration data for calibrating an application amount of the clear recording material, based on the acquired reflection intensity and the target reflection intensity of the specular reflection light stored in the memory.

18. A non-transitory computer-readable storage medium that stores a program configured to execute processing of an information processing method comprising:

applying a clear recording material to a recording medium;

recording a test pattern by forming a second layer of the clear recording material containing no colorant on a first layer formed on the recording medium, the first layer being a layer of a color recording material containing a colorant;

acquiring a reflection intensity of specular reflection light of a test pattern;

storing a target reflection intensity with respect to the application amount of the clear recording material in a memory; and generating calibration data for calibrating an application amount of the clear recording material, based on the acquired reflection intensity and the target reflection intensity of the specular reflection light stored in the memory.

* * * * *